US006692272B2

(12) United States Patent
Lemke et al.

(10) Patent No.: US 6,692,272 B2
(45) Date of Patent: Feb. 17, 2004

(54) HIGH SPEED ELECTRICAL CONNECTOR

(75) Inventors: Timothy A. Lemke, Dillsburg, PA (US); Gregory A. Hull, York, PA (US); Stephen B. Smith, Mechanicsburg, PA (US); Timothy W. Houtz, Etters, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/990,794

(22) Filed: Nov. 14, 2001

(65) Prior Publication Data

US 2003/0092291 A1 May 15, 2003

(51) Int. Cl.[7] ..... H01R 4/66
(52) U.S. Cl. ..... 439/108; 439/941
(58) Field of Search ..... 439/101, 108, 439/939, 608

(56) References Cited

U.S. PATENT DOCUMENTS

| | | | | |
|---|---|---|---|---|
| 5,238,414 A | | 8/1993 | Yaegashi et al. | 439/108 |
| 5,741,144 A | | 4/1998 | Elco et al. | 439/101 |
| 5,817,973 A | | 10/1998 | Elco et al. | 174/32 |
| 5,980,321 A | | 11/1999 | Cohen et al. | 439/608 |
| 5,993,259 A | | 11/1999 | Stokoe et al. | 439/608 |
| 6,146,203 A | | 11/2000 | Elco et al. | 439/609 |
| 6,220,896 B1 | * | 4/2001 | Bertoncini et al. | 439/608 |
| 6,293,827 B1 | | 9/2001 | Stokoe et al. | 439/608 |

FOREIGN PATENT DOCUMENTS

| | | |
|---|---|---|
| WO | WO 01/29931 A1 | 4/2001 |
| WO | WO 01/39332 A1 | 5/2001 |

* cited by examiner

*Primary Examiner*—Neil Abrams
(74) *Attorney, Agent, or Firm*—Woodcock Washburn LLP

(57) ABSTRACT

An electrical connector is provided that includes a first conductor and a second conductor. A respective first portion of each conductor is disposed in a first material and a respective second portion of each conductor is disposed in a second material that is different from the first material. The respective first portions axe disposed a first distance apart and the respective second portions jog relative to each other such that an impedance between the first portions is substantially die same as an impedance between the second portions. For example, the conductor pairs may be at one spacing (d1) at portions in air (160) and at a second spacing (d2) at portions that pass through a different dielectric material, such as polymer (150).

37 Claims, 11 Drawing Sheets

D4 > D3

HIGH SPEED ELECTRICAL CONNECTOR

The subject matter disclosed herein is related to the subject matter disclosed in U.S. patent application Ser. No. 10/294,966, filed Nov. 14, 2002, entitled "Cross Talk Reduction And Impedance-Matching For High Speed Electrical Connectors."

FIELD OF THE INVENTION

The invention relates in general to electrical connectors. More particularly, the invention relates to a high speed connector for connecting between two electrical devices.

BACKGROUND OF THE INVENTION

As the speed of electronics increases, connectors are desired that are capable of high speed communications. Most connectors focus on shielding to reduce cross talk, thereby allowing higher speed communication. However, focusing on shielding addresses only one aspect of communication speed.

Therefore, a need exists for a high speed electrical connector design that addresses high speed communications, beyond the use of shielding.

SUMMARY OF THE INVENTION

The invention is directed to a high speed electrical connector wherein signal conductors of a differential signal pair have a substantially constant differential impedance along the length of the differential signal pair.

According to an aspect of the invention, an electrical connector is provided. The electrical connector comprises a first conductor having a first length and a second conductor having a second length. The impedance between the first and second conductor is substantially constant along the first and second length allowing high speed communications through the connector. The first and second conductors may form a differential signal pair having a differential impedance or a single ended pair having a single ended impedance.

According to another aspect of the invention, the first conductor comprises a first edge along the length of the first conductor and the second conductor comprises a second edge along the length of the conductor. A gap between the first edge and the second edge is substantially constant to maintain a substantially constant impedance.

According to a further aspect of the invention, the electrical connector comprises a plurality of ground conductors and a plurality of differential signal pairs that may be arranged in either rows or columns.

According to yet another aspect of the invention, a first portion of the first conductor is disposed in a first material having a first dielectric constant and a second portion of the first conductor is disposed in a second material having a second dielectric constant. A first portion of the second conductor is disposed in the first material and a second portion of the second conductor is disposed in the second material. The gap between the first conductor and the second conductor in the first material is a first distance and the gap between the first conductor and the second conductor in the second material is a second distance such that the impedance is substantially constant along the length of the conductors.

According to yet another aspect of the invention, a method is provided for making an electrical connector. A plurality of conductors are placed into a die blank, each conductor having a predefined substantially constant gap between it and an adjacent conductor. Material is injected into the die blank to form a connector frame.

The foregoing and other aspects of the invention will become apparent from the following detailed description of the invention when considered in conjunction with the accompanying drawings.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings, and wherein.

DETAILED DESCRIPTION OF ILLUSTRATIVE EMBODIMENTS

Figure 1:
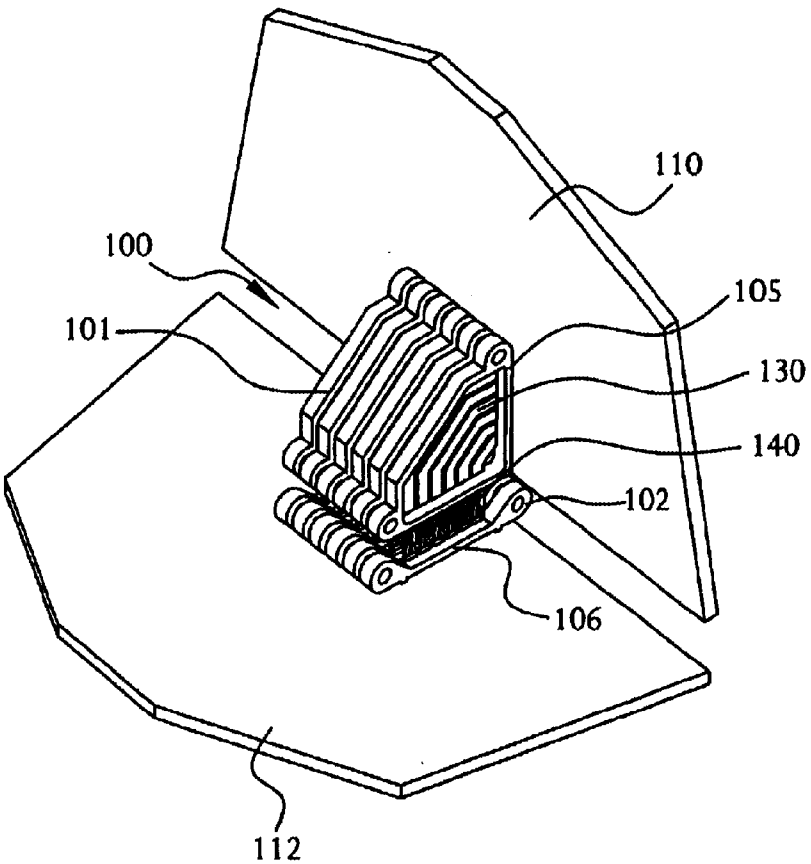
FIG. 1 is a perspective view of an illustrative right angle electrical connector, in accordance with the invention.

The invention is directed to a high speed electrical connector wherein signal conductors of a differential signal pair have a substantially constant differential impedance along the length of the differential signal pair.

Certain terminology may be used in the following description for convenience only and is not considered to be limiting. For example, the words "left", "right", "upper", and "lower" designate directions in the drawings to which reference is made. Likewise, the words "inwardly" and "outwardly" are directions toward and away from, respectively, the geometric center of the referenced object. The terminology includes the words above specifically mentioned, derivatives thereof, and words of similar import.

FIG. 1 is a perspective view of a right angle electrical connector, in accordance with the an embodiment of the invention. As shown in FIG. 1, a connector 100 comprises a first section 101 and a second section 102. First section 101 is electrically connected to a first electrical device 110 and second section 102 is electrically connected to a second electrical device 112. Such connections may be solder connections, solder ball grid array connections, interference fit connections, and the like. Typically, such connections are conventional connections having conventional connection spacing between connection pins; however, such connections may have other spacing between connection pins. First section 101 and second section 102 can be electrically connected together, thereby electrically connecting first electrical device 110 to second electrical device 112.

As can be seen, first section 101 comprises a plurality of modules 105. Each module 105 comprises a column of conductors 130. As shown, first section 101 comprises six modules 105 and each module 105 comprises six conductors 130; however, any number of modules 105 and conductors 130 may be used. Second section 102 comprises a plurality of modules 106. Each module 106 comprises a column of conductors 140. As shown, second section 102 comprises six modules 106 and each module 106 comprises six conductors 140; however, any number of modules 106 and conductors 140 may be used.

Figure 2:
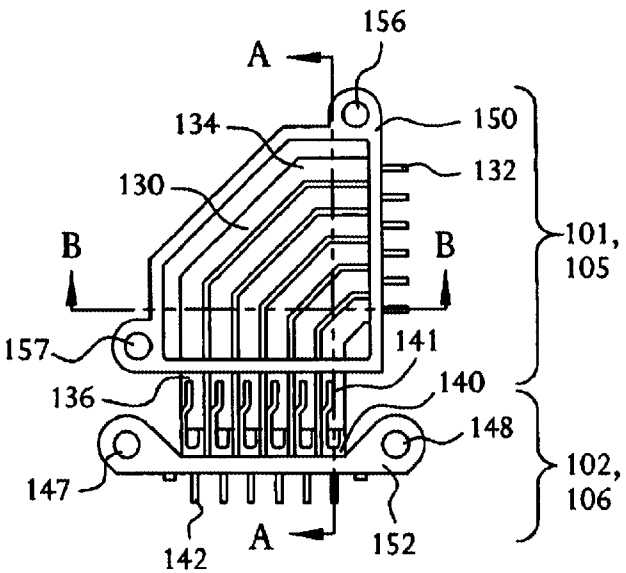
FIG. 2 is a side view of the right angle electrical connector of FIG. 1.

To illustrate further details of connector 100, FIG. 2 is a side view of connector 100. As shown in FIG. 2, each module 105 comprises a plurality of conductors 130 secured in a frame 150. Each conductor 130 comprises a connection pin 132 extending from frame 150 for connection to first electrical device 110, a blade 136 extending from frame 150 for connection to second section 102, and a conductor segment 134 connecting connection pin 132 to blade 136.

Each module 106 comprises a plurality of conductors 140 secured in frame 152. Each conductor 140 comprises a contact interface 141 and a connection pin 142. Each contact interface 141 extends from frame 152 for connection to a blade 136 of first section 101. Each contact interface 140 is also electrically connected to a connection pin 142 that extends from frame 152 for electrical connection to second electrical device 112.

Each module 105 comprises a first hole 156 and a second hole 157 for alignment with an adjacent module 105. In this manner, multiple columns of conductors 130 may be aligned. Each module 106 comprises a first hole 147 and a second hole 148 for alignment with an adjacent module 106. In this manner, multiple columns of conductors 140 may be aligned.

Module 105 of connector 100 is shown as a right angle module. To explain, a set of first connection pins 132 is disposed on a first plane (e.g., coplanar with first electrical device 110) and a set of second connection pins 142 is disposed on a second plane (e.g., coplanar with second electrical device 112) perpendicular to the first plane. To connect the first plane to the second plane, each conductor 130 turns a total of about ninety degrees (a right angle) to connect between electrical devices 110 and 112.

Figure 3:
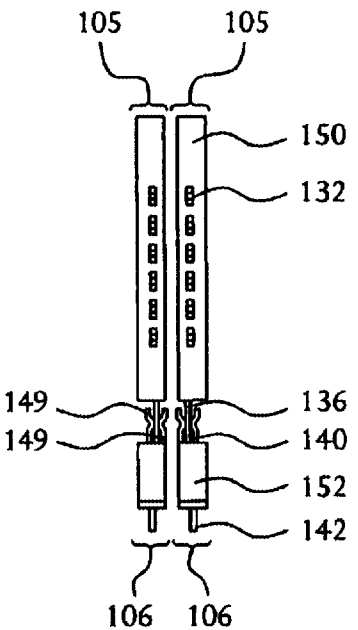
FIG. 3 is a side view of a portion of the right angle electrical connector of FIG. 1 taken along line A—A.
Figure 4:
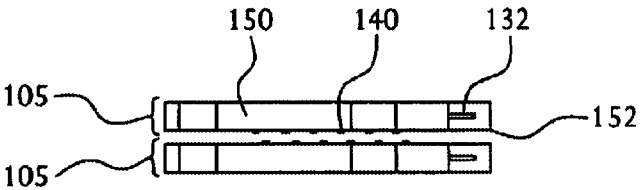
FIG. 4 is a top view of a portion of the right angle electrical connector of FIG. 1 taken along line B—B.

To further illustrate connector 100, FIG. 3 is a side view of two modules of connector 100 taken along line A—A and FIG. 4 is a top view of two modules of connector 100 taken along line B—B. As can be seen, each blade 136 is disposed between two single beam contacts 149 of contact interface 141, thereby providing electrical connection between first section 101 and second section 102 and described in more detail below. Connection pins 132 are disposed proximate to the centerline of module 105 such that connection pins 132 may be mated to a device having conventional connection spacing. Connection pins 142 are disposed proximate to the centerline of module 106 such that connection pins 142 may be mated to a device having conventional connection spacing. Connection pins, however, may be disposed at an offset from the centerline of module 106 if such connection spacing is supported by the mating device. Further, while connection pins are illustrated in the Figures, other connection techniques are contemplated such as, for example, solder balls and the like.

Returning now to illustrative connector 100 of FIG. 1 to discuss the layout of connection pins and conductors, first section 101 of illustrative connector 100 comprises six columns and six rows of conductors 130. Conductors 130 may be either signal conductors S or ground conductors G. Typically, each signal conductor S is employed as either a positive conductor or a negative conductor of a differential signal pair; however, a signal conductor may be employed as a conductor for single ended signaling. In addition, such conductors 130 may be arranged in either columns or rows.

Figure 5:
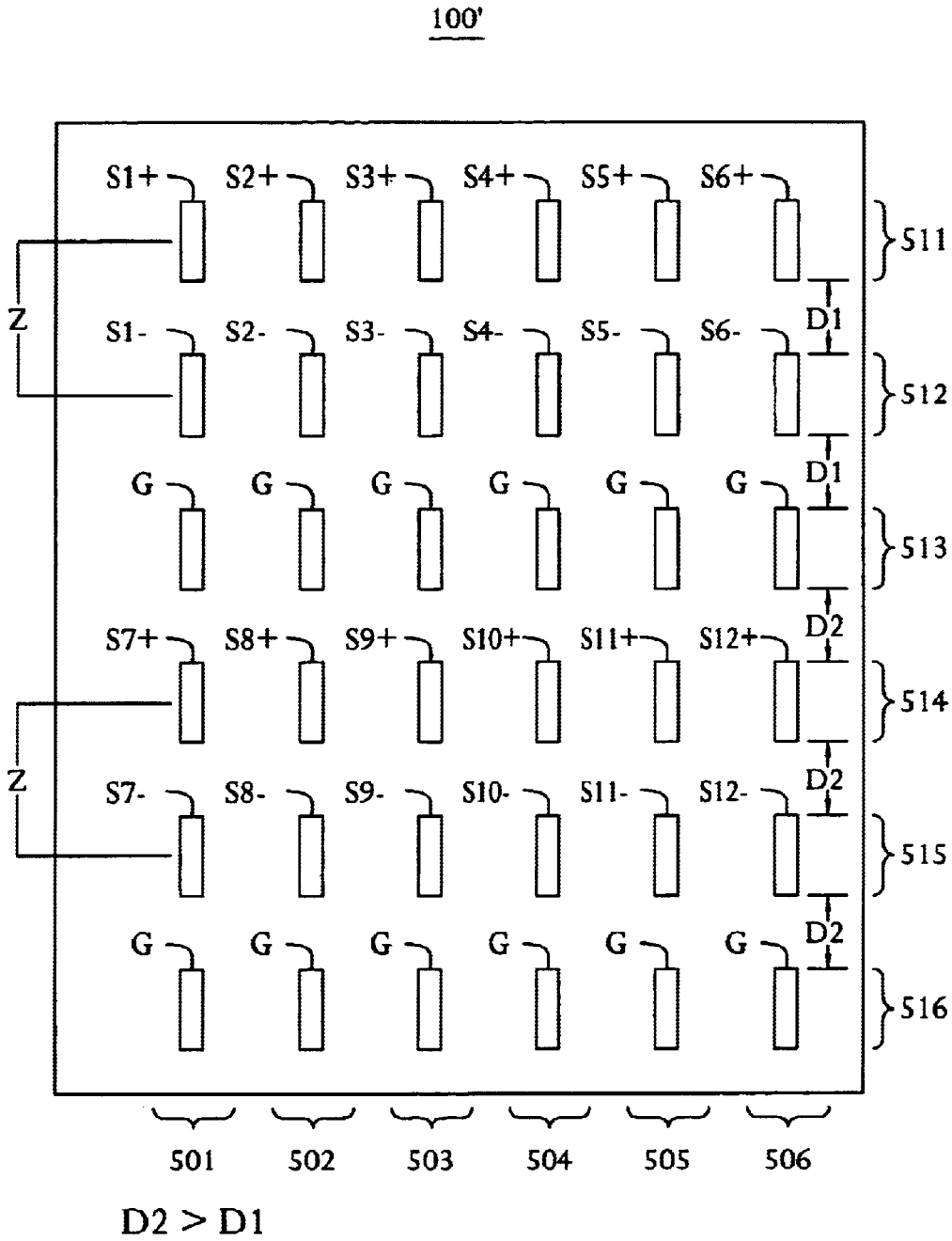
FIG. 5 is a side diagrammatic view of conductors in an illustrative right angle electrical connector, in which the conductors are arranged in columns, in accordance with the invention.

To illustrate arrangement into columns of differential signal pairs, FIG. 5 is a side diagrammatic view of conductors 130 of a connector 100', in which conductors 130 are arranged in columns. As shown in FIG. 5, each column 501–506 comprises, in order from top to bottom, a first differential signal pair, a first ground conductor, a second differential signal pair, and a second ground conductor. As can be seen, first column 501 comprises, in order from top to bottom, a first differential signal pair S1 (comprising signal conductors S1+ and S1−), a first ground conductor G, a second differential signal pair S7, and a second ground conductor G. Rows 513 and 516 comprise all ground conductors. Rows 511–512 comprise differential signal pairs S1 through S6 and rows 514–515 comprise differential signal pairs S7 through S12. As can be seen, in this embodiment, arrangement into columns provides twelve differential signal pairs. Further, because there are no specialized ground contacts in the system, all of the interconnects are desirably substantially identical.

In addition to reducing impedance mismatch, communication performance may be further increased by offsetting a column from an adjacent column. For example, each odd column 501, 503, 505 may be offset from adjacent even columns 502, 504, 506. The amount of offset may be a half pitch, a full pitch, or some other pitch factor. Offsetting column 501 by a full pitch, for example, locates conductor S1− proximate to S2+ rather that S2−. Such offsetting may improve communication performance, however, such offsetting decreases conductor density.

Figure 6:
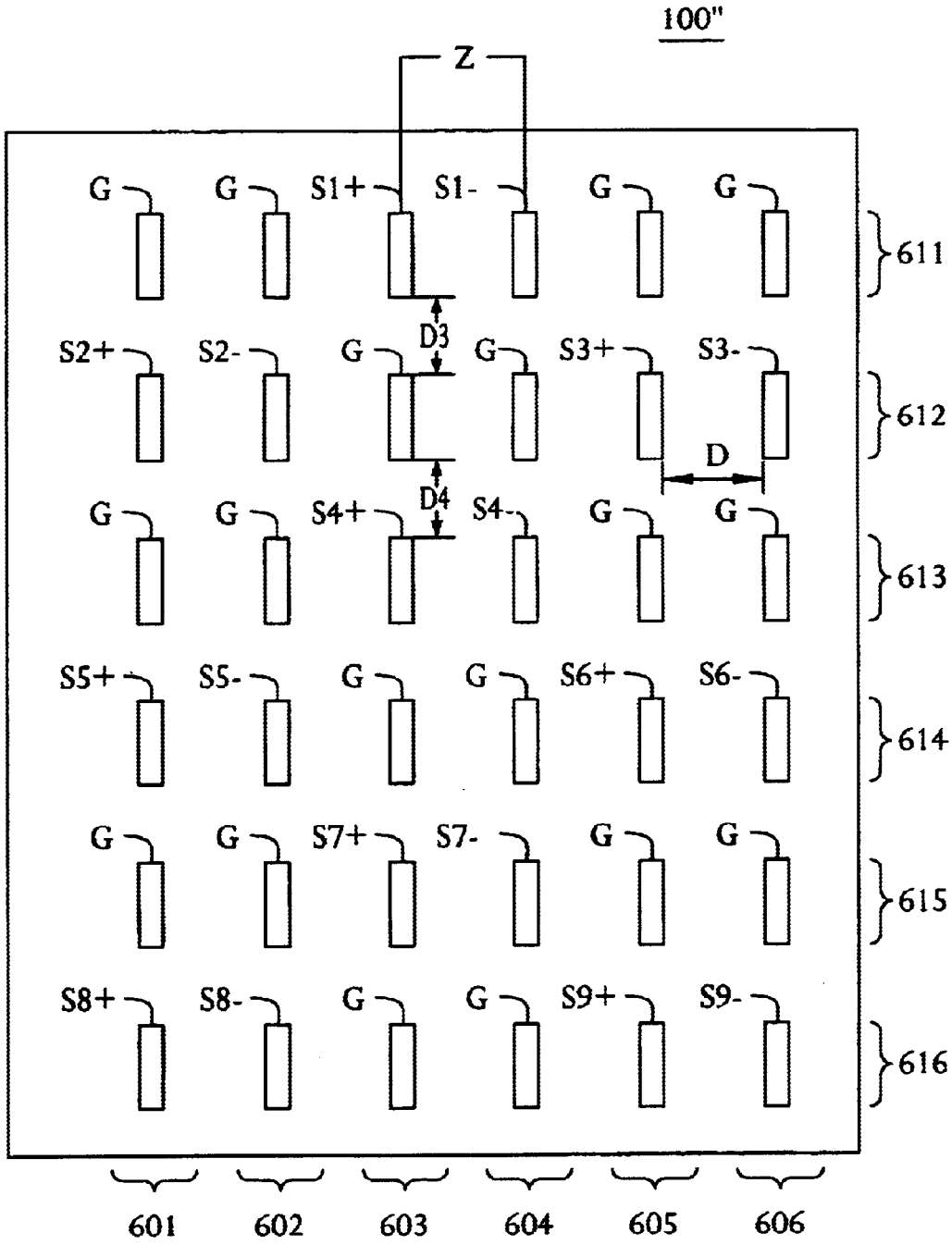
FIG. 6 is a side diagrammatic view of conductors in an illustrative right angle electrical connector, in which the conductors are arranged in rows, in accordance with the invention.

Alternatively, conductors 130 may be arranged in rows. FIG. 6 is a side diagrammatic view of conductors 130 of a connector 100", in which conductors 130 are arranged into rows. As shown in FIG. 6, rows 601–606 comprise a repeating sequence of, two ground conductors and a differential signal pair. As can be seen, first row 611 comprises, in order from left to right, two ground conductors G, a differential signal pair S1, and two ground conductors G. Row 612 comprises in order from left to right, a differential signal pair S2, two ground conductors G, and a differential signal pair S3. As can be seen, in this embodiment, arrangement into rows provides nine differential signal pairs. Again, all interconnects are desirably substantially identical, therefore, a specialized ground contact is not required.

As can be seen, arrangement into columns may have a higher density of signal conductors than arrangement into rows. However, for right angle connectors arranged into columns, conductors within a differential signal pair have different lengths, and therefore, such differential signal pairs may have intra-pair skew. Within a right angle connector, arrangements into both rows and columns may have inter-pair skew because of the different conductor lengths of different differential signal pairs. Selection between columns and rows depends, therefore, on the particular application.

Regardless of which is selected, each differential signal pair Sx has a differential impedance Z between the positive conductor Sx+ and negative conductor Sx− of the differential signal pair. Differential impedance is defined as the impedance existing between two signal conductors of the same differential signal pair, at a particular point along the length of the differential signal pair. It is desired to control differential impedance Z to match the impedance of electrical devices 110, 112. Matching differential impedance Z to the impedance of electrical devices 110, 112 minimizes signal reflection and/or system resonance that can limit overall system bandwidth. Further it is desired to control the differential impedance Z such that it is substantially constant along the length of the differential signal pair i.e., that each differential signal pair has a substantially consistent differential impedance profile.

The differential impedance profile can be controlled by proper positioning of conductors S+, S−, and G. Specifically, differential impedance is determined by the proximity of an edge of signal conductor S to an adjacent ground and by the gap D between edges of signal conductors S within a differential signal pair.

As can be seen in FIG. 5, the differential signal pair S6, comprising signal conductors S6+ and S6−, is located adjacent to one ground conductor G in row 513. The differential signal pair S12, comprising signal conductors S12+ and S12−, is located adjacent to two ground conductors G, one in row 513 and one in row 516. Conventional connectors include two ground conductors adjacent to each differential signal pair to minimize impedance matching problems. Removing one of the ground conductors typically leads to impedance mismatches that reduce communications speed. However, the present invention compensates for the lack of one adjacent ground conductor by reducing the gap between the differential signal pair conductors with only one adjacent ground conductor. That is, in the illustrative connector 100', signal conductors S6+ and S6− are located a distance D1 apart from each other, whereas, signal conductors S 12+ and S12− are located a larger distance D2 apart from each other. The distances may be controlled by making the widths of signal conductors S6+ and S6− wider than the widths of signal conductors S 12+ and S12−.

For single ended signaling, single ended impedance is controlled by proper positioning of conductors S and G. Specifically, single ended impedance is determined by the gap D between signal conductor S and an adjacent ground. Single ended impedance is defined as the impedance existing between a signal conductor and ground, at a particular point along the length of a single ended signal conductor.

The present invention may also compensate for the lack of an adjacent ground conductor in the connector of FIG. 6 by reducing the gap between the differential a signal pair conductor and a proximate ground conductor. That is, in the illustrative connector 100", signal conductor S1+ is located a distance D3 apart from the proximate ground conductor G, whereas, signal conductors S4+ is located a larger distance D4 apart the proximate ground conductor. The distances may be controlled by varying the widths of signal conductors S and ground conductors G.

The gap should be controlled within several thousandths of an inch to maintain acceptable differential impedance control for high bandwidth systems. Gap variations beyond several thousandths may cause unacceptable variation in the impedance profile; however, the acceptable variation is dependent on the speed desired, the error rate acceptable, and other design factors.

Returning now to FIG. 2, to simplify conductor placement, in the present embodiment, conductors 130 have a rectangular cross section; however, conductors 130 may be any shape. In this embodiment, conductors 130 have a high aspect ratio of width to thickness to facilitate manufacturing. The particular aspect ratio may be selected based on various design parameters including the desired communication speed, connection pin layout, and the like.

In addition to conductor placement, differential impedance is affected by the dielectric properties of material proximate to the conductors. While air is a desirable dielectric for reducing cross talk, frame 150 and frame 152 may comprise a polymer, a plastic, or the like to secure conductors 130 and 140 so that desired gap tolerances may be maintained. Therefore, conductors 130 and 140 are disposed both in air and in a second material (e.g., a polymer) having a second dielectric property. Therefore, to provide a substantially constant differential impedance profile, in the second material, the spacing between conductors of a differential signal pair may vary.

Figure 7:
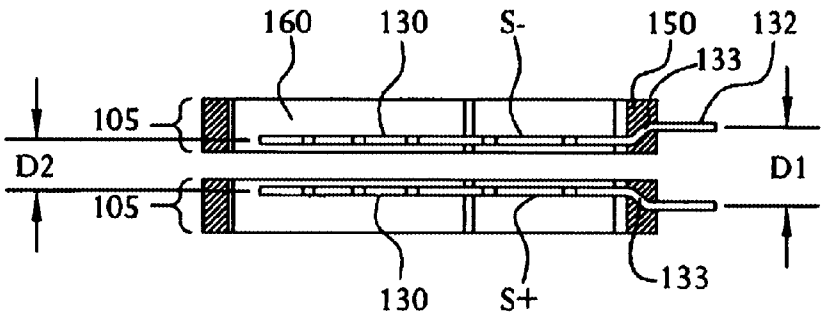
FIG. 7 is a top cut-away view of conductors of the right angle electrical connector of FIG. 1 taken along line B—B.

FIG. 7 illustrates the change in spacing between conductors in rows as conductors pass from being surrounded by air to being surrounded by frame 150. As shown in FIG. 7, at connection pin 132 the distance between conductor S+ and S− is d1. Distance d1 may be selected to mate with conventional connector spacing on first electrical device 110 or may be selected to optimize the differential impedance profile. As shown, distance d1 is selected to mate with a conventional connector and is disposed proximate to the centerline of module 105. As conductors S+ and S− travel from connection pins 132 through frame 150, portions 133 of conductors S+, S− jog towards each other, culminating in a separation distance d2 in air region 160. Distance d2 is selected to give the desired differential impedance between conductor S+ and S−, given other parameters, such as proximity to a ground conductor G. For example, given a spacing d1, spacing d2 may be chosen to provide for a constant differential impedance Z along the length of the conductor S+, S−. The desired differential impedance Z depends on the system impedance (e.g., first electrical device 110), and may be 100 ohms or some other value. Typically, a tolerance of about 5 percent is desired; however, 10 percent may be acceptable for some applications. It is this range of 10% or less that is considered substantially constant differential impedance.

Figure 8:
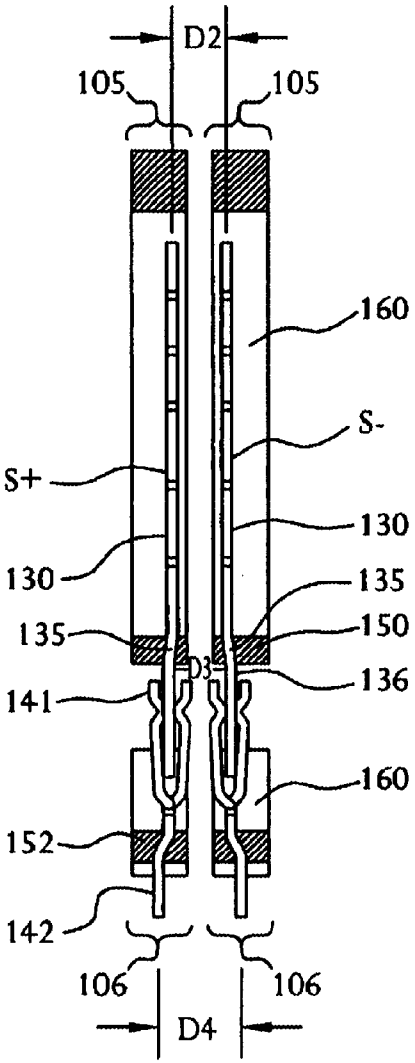
FIG. 8 is a side cut-away view of a portion of the right angle electrical connector of FIG. 1 taken along line A—A.

As shown in FIG. 8, conductors S+ and S− are disposed from air region 160 towards blade 136 and portions 135 jog outward with respect to each other within frame 150 such that blades 136 are separated by a distance d3 upon exiting frame 150. Blades 136 are received in contact interfaces 141, thereby providing electrical connection between first section 101 and second section 102. As contact interfaces 141 travel from air region 160 towards frame 152, contact interfaces 141 jog outwardly with respect to each other, culminating in connection pins 142 separated by a distance of d4. As shown, connection pins 142 are disposed proximate to the centerline of frame 152 to mate with conventional connector spacing.

Figure 9:
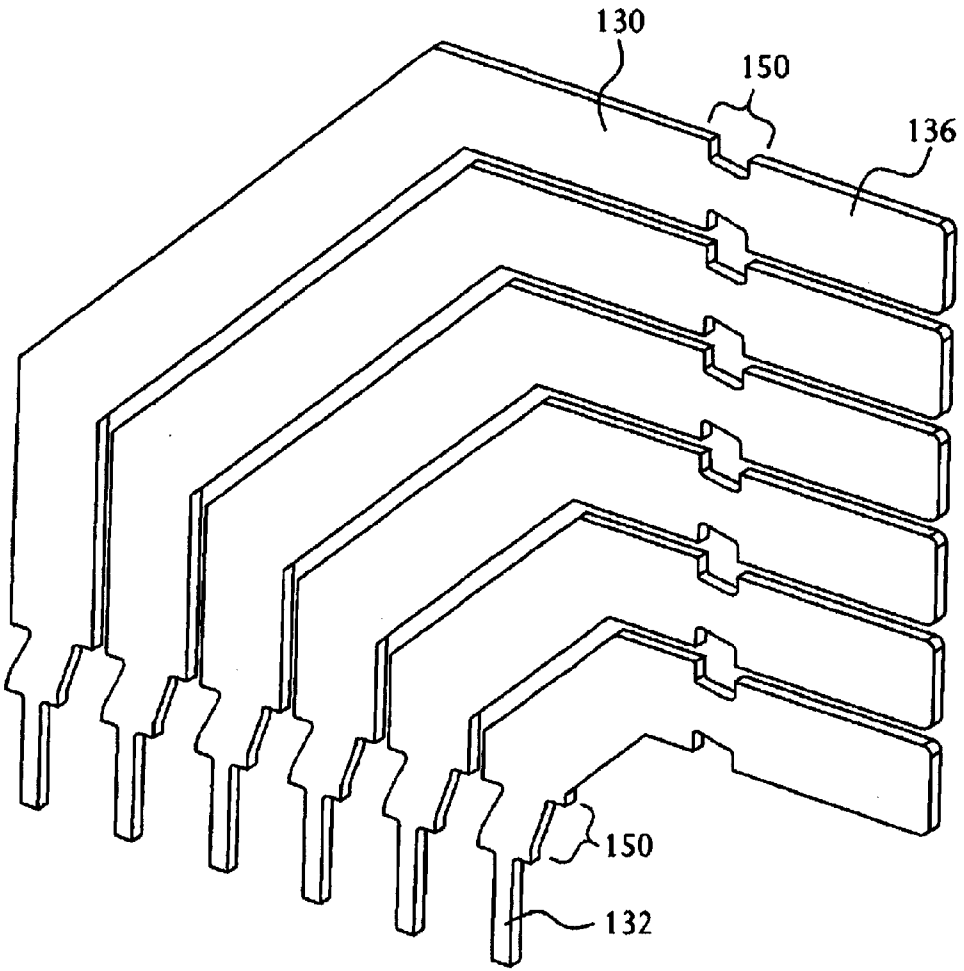
FIG. 9 is a perspective view of another illustrative conductor of the right angle electrical connector of FIG. 1.

To better illustrate the jogging of conductors 130, FIG. 9 is a perspective view of conductors 130. As can be seen, within frame 150, conductors 130 jog, either inward or outward to maintain a substantially constant differential impedance profile and to mate with connectors on first electrical device 110.

Figure 10:
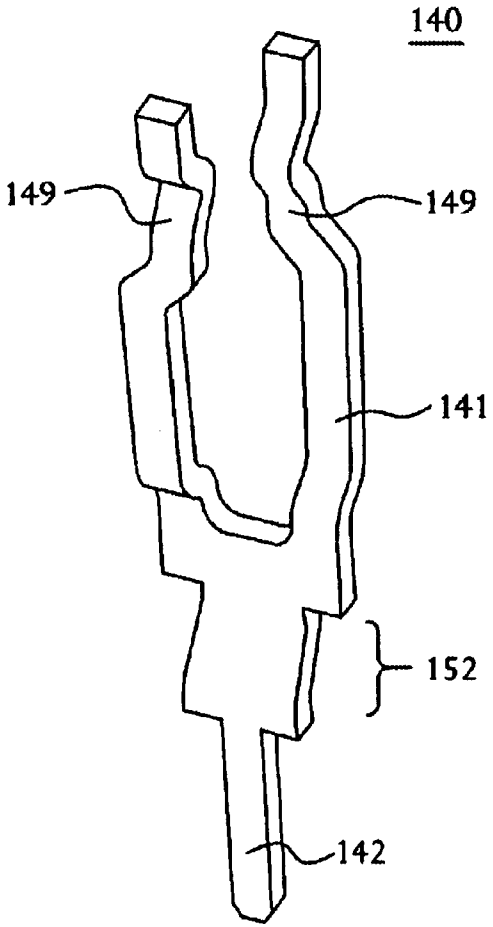
FIG. 10 is a perspective view of another illustrative portion of the right angle electrical connector of FIG. 1.

To better illustrate the jogging of conductors 140, FIG. 10 is a perspective view of conductor 140. As can be seen, within frame 152, conductor 140 jogs, either inward or outward to maintain a substantially constant differential impedance profile and to mate with connectors on second electrical device 112.

For arrangement into columns, conductors 130 and 140 are disposed along a centerline of frames 150, 152, respectively.

The design of contact interface 141 provides impedance matching of connector 100 to electrical devices 110, 112.

One contact interface design (not shown) includes a single or bifurcated contact beam. This design is easy to both predict and control; however, one potential liability is that single beams can be difficult to design to have adequate reliability. Further, there is some concern that single beams can overstress some attachments such as ball grid arrays.

FIG. 10 is another design that includes two single beam contacts 149, one beam contact 149 on each side of blade 136. This design may provide reduced cross talk performance, because each single beam contact 149 is further away from its adjacent contact. Also, this design may provide increased contact reliability, because it is a "true" dual contact. This design may also reduce the tight tolerance requirements for the positioning of the contacts and forming of the contacts.

Figure 11:
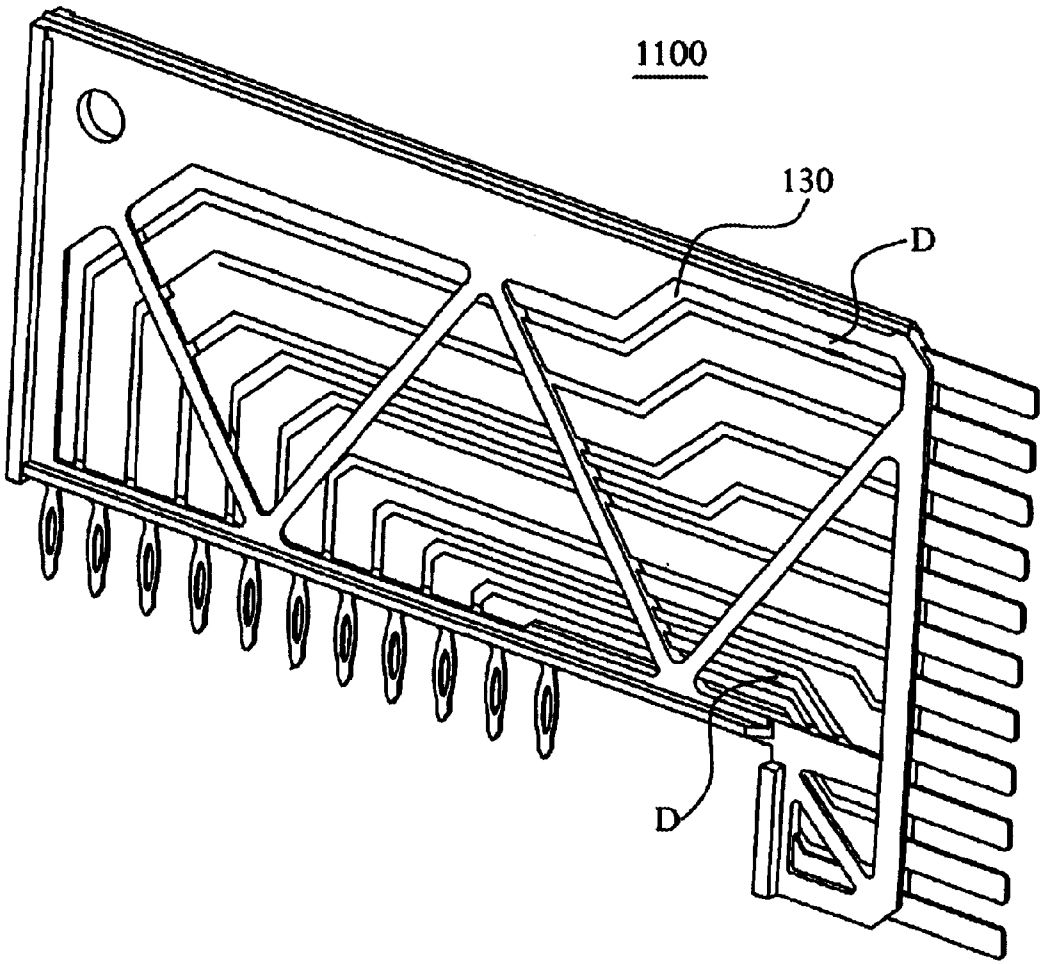
FIG. 11 is a perspective view of a portion of another illustrative right angle electrical connector, in accordance with the invention.

FIG. 11 is a perspective view of a portion of another embodiment of a right angle electrical connector 1100. As shown in FIG. 11, conductors 130 are disposed from a first plane to a second plane that is orthogonal to the first plane. Distance D between adjacent conductors 130 remains substantially constant, even though the width of conductor 130 may vary and even though the path of conductor 130 may be circuitous. This substantially constant gap D provides a substantially constant differential impedance between adjacent conductors.

Figure 12:
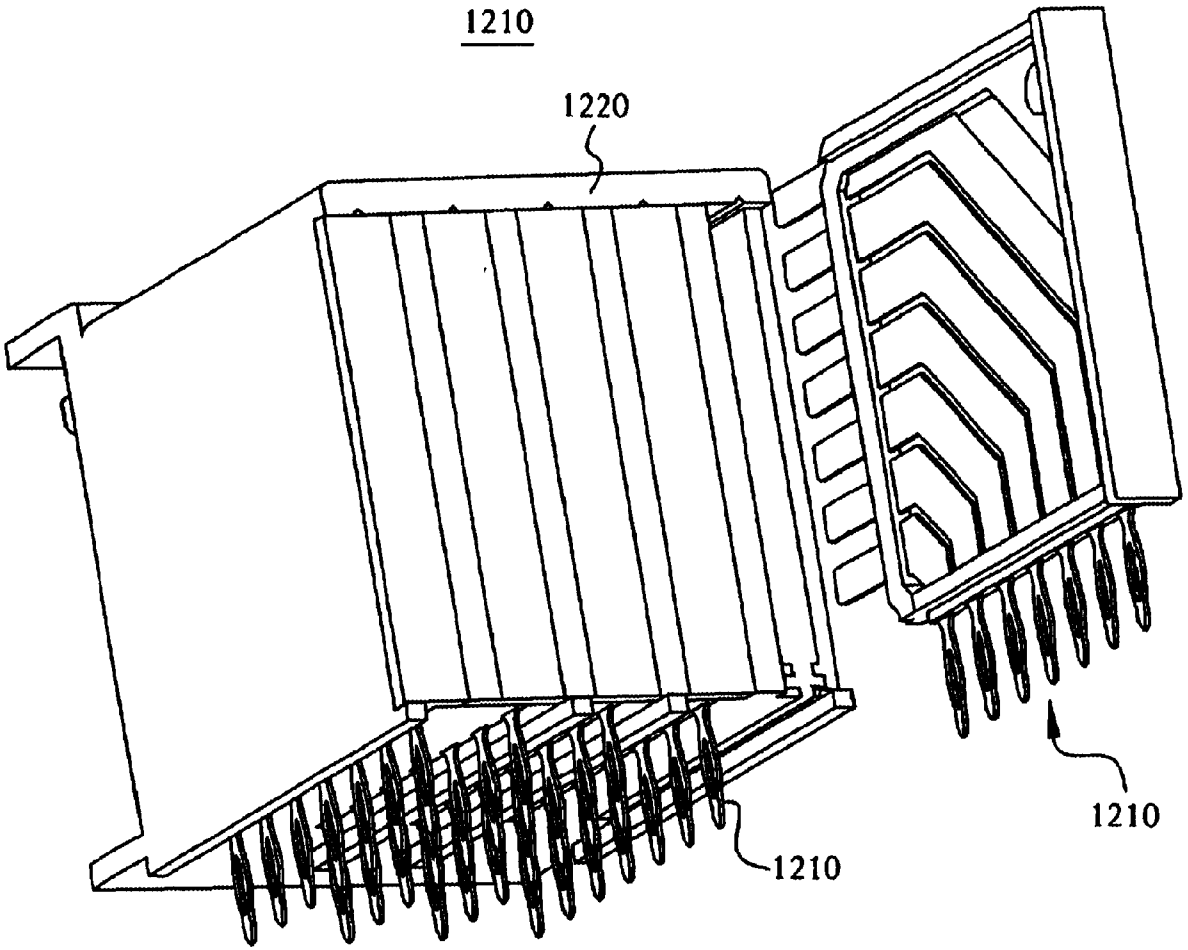
FIG. 12 is a perspective view of another illustrative right angle electrical connector, in accordance with the invention.

FIG. 12 is a perspective view of another embodiment of a right angle electrical connector 1200. As shown in FIG. 12, modules 1210 are disposed in a frame 1220 to provide proper spacing between adjacent modules 1210.

Figure 13:
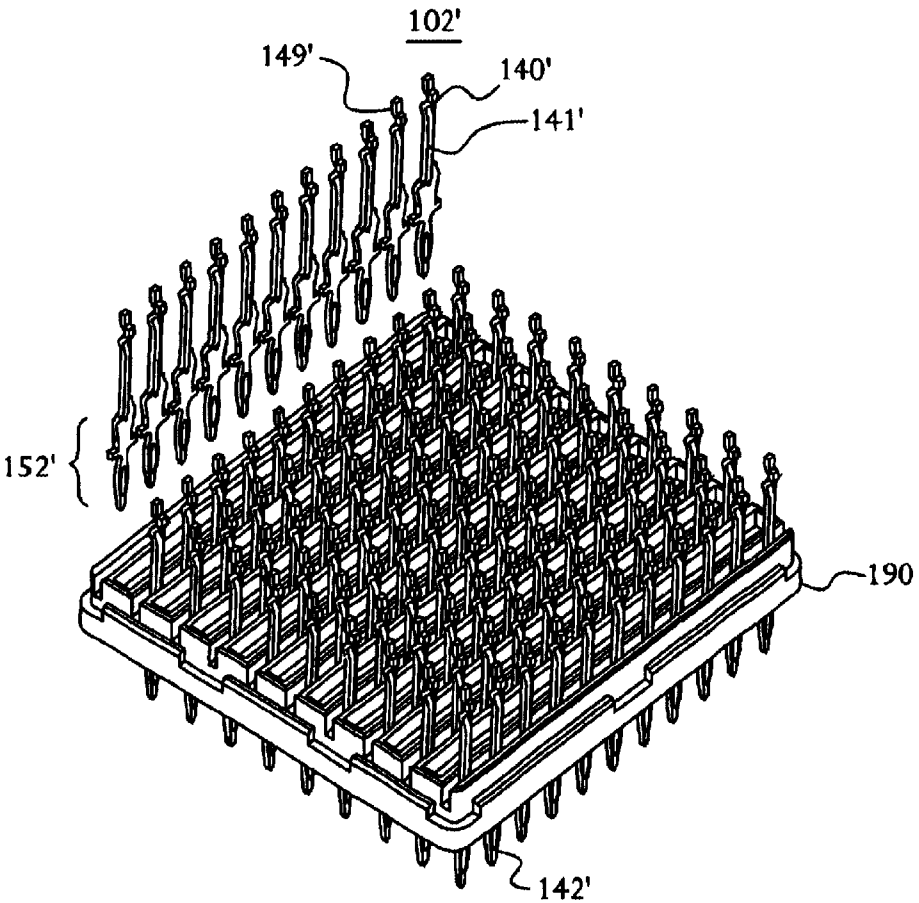
FIG. 13 is a perspective view of an alternative section of the illustrative electrical connector of FIG. 1.

FIG. 13 is a perspective view of an alternate second section 102' of a right angle electrical connector. As shown in FIG. 13, second section comprises a frame 190 to provide proper spacing between connection pins 142'. Frame 190 comprises recesses, in which conductors 140' are secured. Each conductor 140' comprises a contact interface 141' and a connection pin 142'. Each contact interface 141' extends from frame 190 for connection to a blade 136 of first section 101. Each contact interface 140' is also electrically connected to a connection pin 142' that extends from frame 190 for electrical connection to second electrical device 112. Second section 102' may be assemble via a stitching process.

Figure 14:
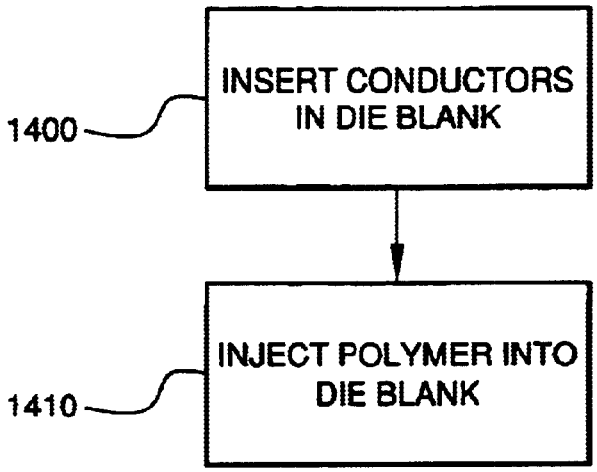
FIG. 14 is a flow diagram of a method for making a connector in accordance with the invention.

To attain desirable gap tolerances over the length of conductors 103, connector 100 may be manufactured by the method as illustrated in FIG. 14. As shown in FIG. 14, at step 1400, conductors 130 are placed in a die blank with predetermined gaps between conductors 130. At step 1410, polymer is injected into the die blank to form the frame of connector 100. The relative position of conductors 130 are maintained by frame 150. Subsequent warping and twisting caused by residual stresses can have an effect on the variability, but if well designed, the resultant frame 150 should have sufficient stability to maintain the desired gap tolerances. In this manner, gaps between conductors 130 can be controlled with variability of tenths of thousandths of an inch.

As can be appreciated, the invention provides a high speed electrical connector wherein signal conductors of a differential signal pair have a substantially constant differential impedance along the length of the differential signal pair. Further, the invention may be applied to single ended signaling, wherein a signal conductor has a substantially constant single ended impedance along the length of the signal conductor.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed:

1. An electrical connector comprising:

a first conductor and a second conductor, wherein a respective first portion of each said conductor is disposed in a first material and a respective second portion of each said conductor is disposed in a second material that is different from the first material, and wherein the respective first portions are disposed a first distance apart and the respective second portions jog relative to each other such that an impedance between the first portions is substantially the same as an impedance between the second portions.

2. The electrical connector as recited in claim 1, wherein the first and second conductors form a differential signal pair and the impedances are differential impedances.

3. The electrical connector as recited in claim 1, wherein the first conductor is a signal conductor, the second conductor is a ground conductor, and the impedances are single ended impedances.

4. The electrical connector as recited in claim 1, wherein the first conductor comprises a first edge along the first portion thereof, the second conductor comprises a second edge along the first portion thereof, and a gap between the first edge and the second edge has a substantially constant gap width along the respective first portions.

5. The electrical connector as recited in claim 1, wherein the conductors are edge-coupled.

6. The electrical connector as recited in claim 1, wherein the conductors are broadside-coupled.

7. The electrical connector as recited in claim 1, wherein the first and second conductors are conductors of a differential signal pair, the electrical connector further comprising:

a plurality of differential signal pairs of conductors, each differential signal pair having a substantially constant impedance between the pair of conductors; and a plurality of ground conductors, each ground conductor disposed adjacent to one of the plurality of differential signal pairs.

8. The electrical connector as recited in claim 7, wherein the plurality of ground conductors and the plurality of differential signal pairs are arranged in rows.

9. The electrical connector as recited in claim 7, wherein the plurality of ground conductors and the plurality of differential signal pairs are arranged in columns.

10. The electrical connector as recited in claim 7, wherein a gap between conductors of a differential signal pair adjacent to only one ground is smaller than a gap between conductors of a differential signal pair adjacent to two grounds.

11. The electrical connector as recited in claim 1, wherein a first gap between the respective portions of the conductors in the first material is a first distance and a second gap between the respective portions of the conductors in the second material is a second distance.

12. The electrical connector as recited in claim 1, wherein the first material comprises air and the second material comprises a polymer.

13. The electrical connector as recited in claim 1, wherein each of the first and second conductors culminates in a respective blade.

14. The electrical connector as recited in claim 1, wherein each of the first and second conductors culminates in two respective single beam contacts.

15. The electrical connector as recited in claim 1, wherein each of the first and second conductors enters the connector at a respective first plane and exits the connector at a respective second plane that is substantially orthogonal to the respective second plane.

16. The connector as recited in claim 1, further comprising an insulator encapsulating a respective portion of each of the first and second conductors.

17. The connector as recited in claim 1, further comprising an injection molded insulating portion securing the first and second conductors.

18. The connector as recited in claim 1, wherein a respective third portion of each said conductor is disposed in a third material, and wherein the respective third portions are disposed a third distance apart such that an impedance between the third portions is substantially the same as the impedance between the first and second portions.

19. An electrical connector comprising:

a first differential signal pair of electrical contacts disposed in a first linear contact array and adjacent to only one ground contact disposed in the first linear contact array; and a second differential signal pair of electrical contacts disposed in the first linear contact array and adjacent to each of a plurality of ground contacts disposed in the first linear contact array;

wherein a gap between the contacts of the first differential signal pair is smaller than a gap between the contacts of the second differential signal pair.

20. The electrical connector of claim 19, wherein a differential impedance between the contacts of the first differential signal pair is about the same as the differential impedance between the contacts of the second differential signal pair.

21. The electrical connector of claim 19, wherein the electrical contacts of the first differential signal pair are edge-coupled.

22. The electrical connector of claim 21, wherein at least one of the electrical contacts of the first differential signal pair is edge-coupled with the only one ground contact.

23. The electrical connector of claim 19, wherein the electrical contacts of the second differential signal pair are edge-coupled.

24. The electrical connector of claim 23, wherein at least one of the electrical contacts of the first differential signal pair is edge-coupled with a respective one of the plurality of ground contacts.

25. The electrical connector of claim 19, wherein the second differential signal pair is disposed adjacent to the only one ground contact.

26. The electrical connector of claim 19, further comprising a second linear contact array adjacent to the first linear contact array.

27. The electrical connector of claim 26, wherein the first linear contact array is staggered relative to the second linear contact array.

28. An electrical connector comprising:

a first electrical contact disposed in a first linear contact array and adjacent to only one ground contact disposed in the linear contact array; and a second electrical contact disposed in the first linear contact array and adjacent to each of a plurality of ground contacts disposed in the first linear contact array;

wherein a gap between the first electrical contact and the only one ground contact is smaller than a gap between the second electrical contact and any of the plurality of ground contacts.

29. The electrical connector of claim 28, wherein the first electrical contact is a one of a first differential signal pair of electrical contacts and the second electrical contact is a one of a second differential signal pair of electrical contacts.

30. The electrical connector of claim 29, wherein a differential impedance between the contacts of the first differential signal pair is about the same as the differential impedance between the contacts of the second differential signal pair.

31. The electrical connector of claim 29, wherein the electrical contacts of the first differential signal pair are broadside-coupled.

32. The electrical connector of claim 28, wherein the first electrical contact is edge-coupled with the only one ground contact.

33. The electrical connector of claim 28, wherein the electrical contacts of the second differential signal pair are edge-coupled.

34. The electrical connector of claim 28, wherein the second electrical contact is edge-coupled with at least one of the plurality of ground contacts.

35. The electrical connector of claim 28, wherein the second electrical contact is disposed adjacent to the only one ground contact.

36. The electrical connector of claim 28, further comprising a second linear contact array adjacent to the first linear contact array.

37. The electrical connector of claim 36, wherein the first linear contact array is staggered relative to the second linear contact array.

* * * * *